United States Patent [19]

Copeland et al.

[11] 4,207,733

[45] Jun. 17, 1980

[54] ELAPSED TIME INDICATOR

[75] Inventors: Leonard H. Copeland, York; Joseph B. Wible, Lancaster, both of Pa.

[73] Assignee: Datcon Instrument Company, East Petersburg, Pa.

[21] Appl. No.: 940,479

[22] Filed: Sep. 7, 1978

[51] Int. Cl.[2] ..... G04F 8/00; G04B 15/00; G04B 19/02

[52] U.S. Cl. ..... 368/108; 368/78; 368/124; 368/222

[58] Field of Search ..... 58/7, 23 R, 23 A, 23 D, 58/39.5, 125 R, 125 C, 126 R, 126 E, 116 R, 126; 74/141.5; 235/92 F, 92 H, 104

[56] References Cited

U.S. PATENT DOCUMENTS

| | | | |
|---|---|---|---|
| 1,223,778 | 4/1917 | Ericson | 58/39.5 |
| 2,946,227 | 7/1960 | Denton et al. | 94/1.5 |
| 3,439,545 | 4/1969 | Siot | 74/1.5 |
| 3,657,875 | 4/1972 | Radnik et al. | 58/23 D |
| 3,817,027 | 6/1974 | Wittner | 58/130 R |
| 3,901,436 | 8/1975 | Van Bennekom et al. | 235/104 |
| 3,908,353 | 9/1975 | Graziano | 58/23 A |
| 3,910,028 | 10/1975 | Suard | 58/28 B |
| 3,931,705 | 1/1976 | Iwaki et al. | 58/125 C |

FOREIGN PATENT DOCUMENTS 55828 10/1912 Austria ..... 58/116

OTHER PUBLICATIONS

Bickford, John, *Mechanisms for Intermittent Motion*, 1972, Industrial Press, pp. 176–180.

*Primary Examiner*—Vit W. Miska

*Attorney, Agent, or Firm*—LeBlanc, Nolan, Shur & Nies

[57] ABSTRACT

An elapsed time indicator is provided which performs accurate and reliable time measurements. The device includes an indicator assembly having a plurality of numbered wheels drivingly coupled to a drive wheel having a plurality of upstanding peripheral teeth. A verge escapement mechanism employs a side acting verge member which moves in a predetermined plane and acts on only one side of the drive wheel. The peripheral teeth of the drive wheel cooperate with the verge member to move the drive wheel through predetermined intervals and drive the numbered wheels of the indicator assembly. An electromagnet pulsed by a solid state time base and driver circuit oscillates the verge member to advance the drive wheel and to operate the indicator assembly.

27 Claims, 11 Drawing Figures

FIG. 4
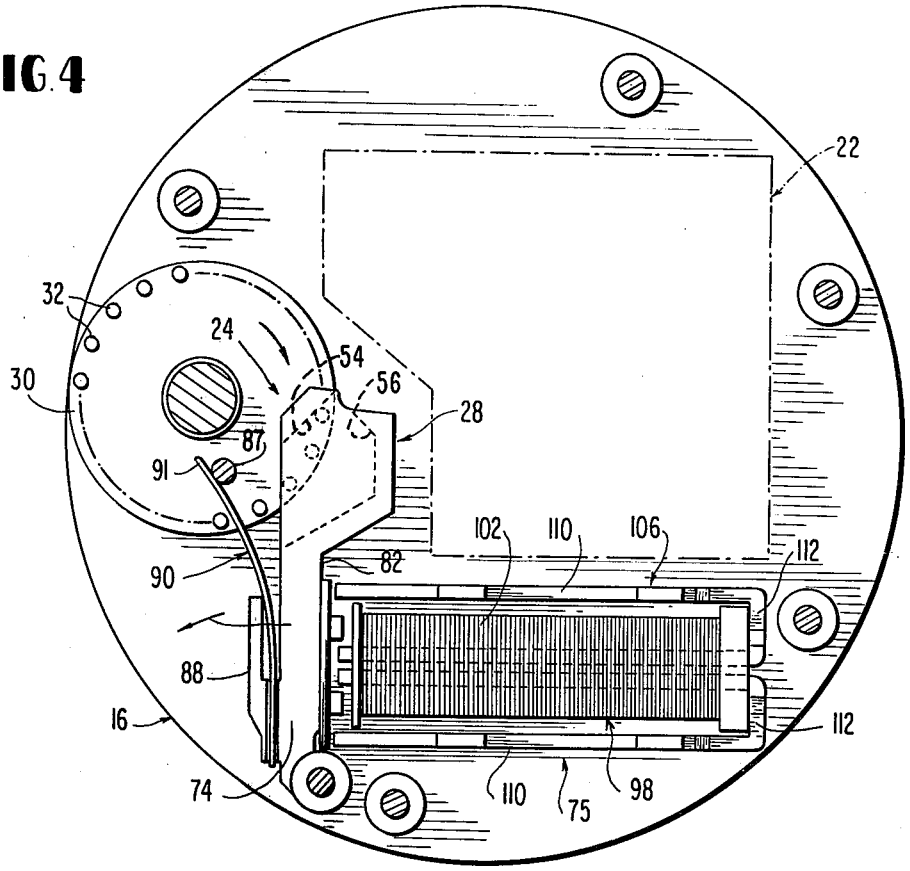
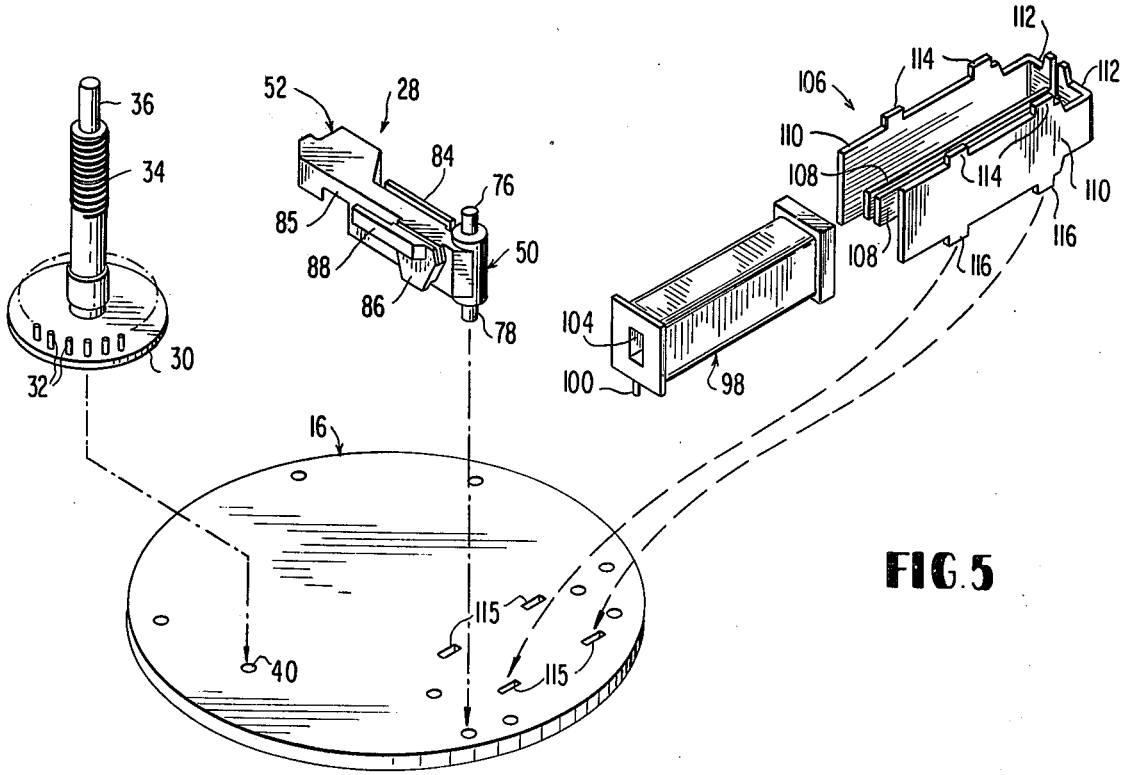
FIG. 5

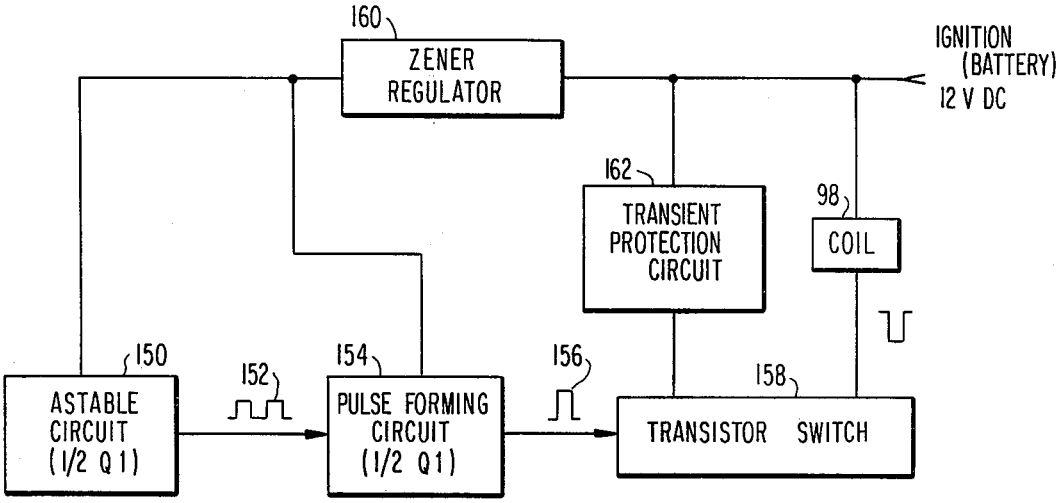
FIG. 10
FIG. 11
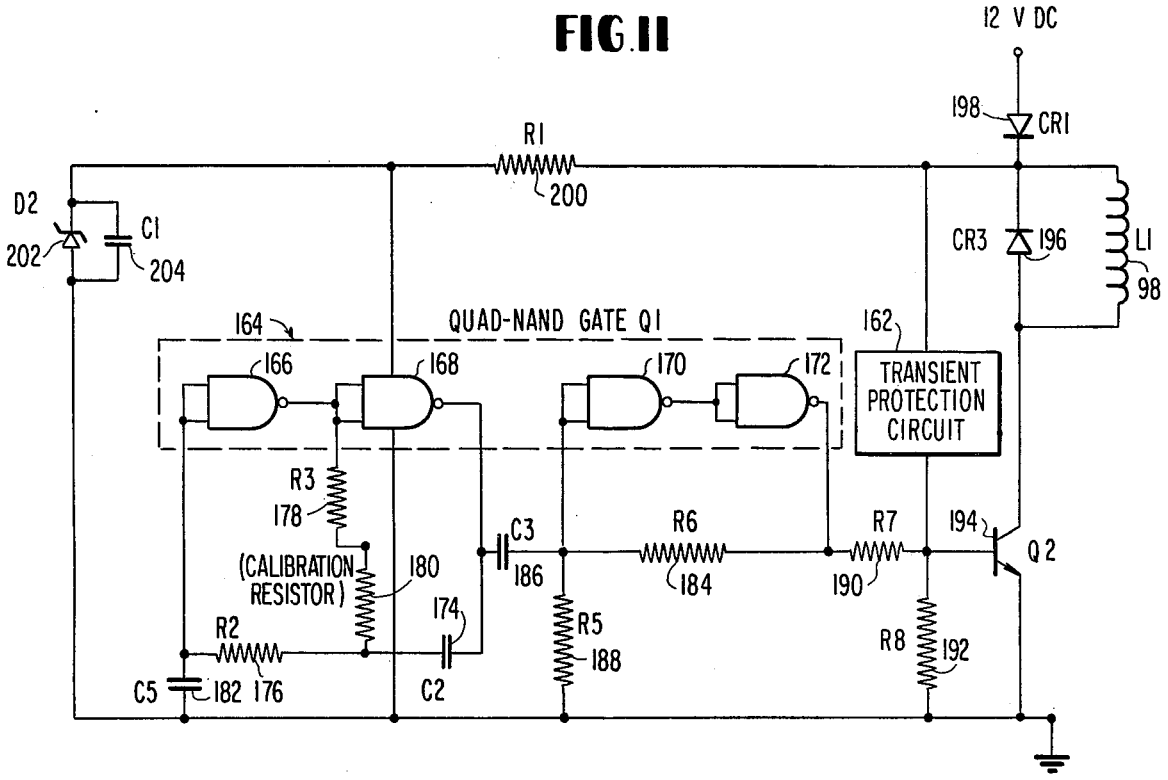

ELAPSED TIME INDICATOR

BACKGROUND OF THE INVENTION

Solid state elapsed time indicators have been available for some time to indicate aggregate running time. However, they have not been readily adopted by the general public due to various inefficiencies which have plagued these types of indicators, usually related to their inordinate cost, their size, as well as unusual sensitivity to vibration. The verge mechanism which has typically been employed in such indicators, has suffered from the inability to maintain close dimensional tolerances rendering the indicator unreliable over long periods of time. Also, there is substantial electrical sensitivity to voltage and temperature variations, and poor resistance to voltage transients and spikes on the input power lines and susceptibility to radiated noise.

It is an object of the invention described herein to overcome many of the problems which have plagued solid state elapsed time indicators as explained above and to make them more efficient, more accurate and less costly so that they may be more readily accepted by the general public.

It is another object to use a drive mechanism which reduces the drive torque required to create a corresponding reduction in the electromagnet size needed to operate the drive mechanism.

It is further object of the invention to provide an inverse escapement mechanism for acting on drive wheel teeth which is much less sensitive to dimensional changes due to wear, temperature and manufacturing tolerances than verge mechanisms which have existed heretofore.

It is still another object to arrive at a design for fixing the various elements comprising the elapsed time indicator together within a housing at minimal effort to reduce cost while increasing the efficiency of operation of the indicator.

Another object of the invention is to provide an improved verge escapement mechanism in which a verge member is driven by an electromagnet under the control of a solid state time base and driver circuit.

It is another object of the invention to employ unique core frame assembly with the electromagnet to readily and quickly place the electromagnet in the proper position relative to the verge member without relying on air gap adjustments and other assembly tasks which have been required before.

These and other objects will become more apparent from the detailed description of the preferred embodiment and the claims which follow hereinafter.

SUMMARY OF THE INVENTION

The invention generally relates to a solid state elapsed time indicator which is more efficient in operation and constructional features than indicators which have existed heretofore.

More particularly, as will be described in the preferred embodiment herein, the indicator includes a verge escapement mechanism employing a side acting verge member which moves in a predetermined plane and acts only on one side of the drive wheel carrying the teeth which cooperate with the verge member to move the drive wheel at predetermined intervals. As worm gear is connected to the drive wheel and engages a drive gear which in turn drives the numbered wheels on the indicator. This verge escapement mechanism, in cooperation with the worm and drive gear configuration, reduces the drive torque required to move the numbered wheels through the predetermined intervals.

An electromagnet employing a core frame assembly is used with locating holes in parts of the housing to quickly and efficiently locate the electromagnet at the predetermined position relative to the verge mechanism within the housing. Plates located at different levels relative to each other are used to carry the various circuitry and other mechanisms required to move the numbered wheels through the intervals. An elastomeric shock shield is secured to one of these plates in conjunction with the case for carrying the component to provide vibration and shock dampening.

Preferably, a solid state time base and driver circuit is employed to energize the electromagnet. The time base and driver circuit comprises an astable multivibrator for producing pulses at predetermined intervals and a pulse forming circuit for amplifying and shaping the pulses to produce a controlled pulse output which is applied to a transistor switch to energize the electromagnet. The solid state design of the time base and driver circuit improves the stability and reliability of its operation and advantageously allows the circuit to operate with a low current requirement.

BRIEF DESCRIPTION OF THE DRAWINGS

The above and other objects of the invention will be readily apparent with reference to the drawings and following descriptions wherein:

FIG. 4 is a plan view partially in section taken along line 4—4 of FIG. 2 illustrating the drive wheel, verge member and electromagnet;

FIG. 5 is an exploded perspective view of the drive wheel and worm gear, verge member and electromagnet;

FIG. 10 is a block diagram of a time base and driver circuit employed to actuate the electromagnet; and FIG. 11 is a detailed schematic diagram illustrating the components of the time base and driver circuit.

DETAILED DESCRIPTION OF THE PREFERRED EMBODIMENT

Figure 1:
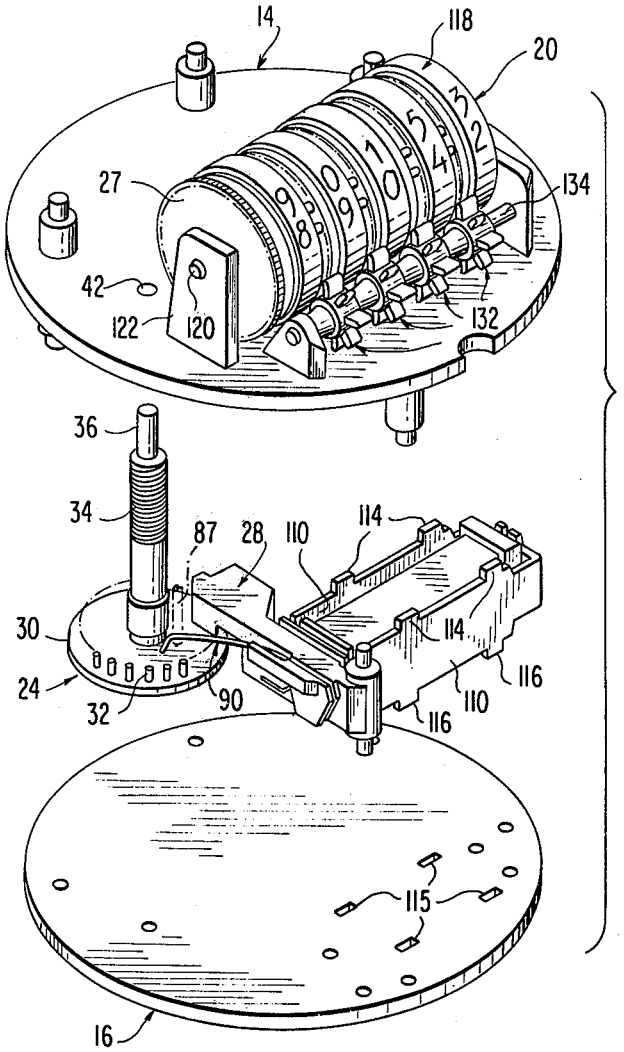
FIG. 1 is an exploded perspective view of an elapsed time indicator including an indicator assembly, a drive wheel and worm gear, and a verge member operable by an electromagnet.

Referring to FIG. 1, the indicator generally referred to by reference number 10 includes an upper plate 12 (see FIG. 3) which covers only a portion of the device, a middle plate 14 and a lower plate 16 all spaced from one another and carrying various components of the indicator. The upper plate 12 carries a time base circuit 18 (shown in dashed lines in FIG. 3) and only extends partially across the indicator to allow exposure of the indicator assembly 20. A drive circuit 22 (shown in dashed lines in FIG. 4) is integrated predominantly on the lower plate 16 between it and the middle plate 14 to drive the verge escapement assembly 24 as best seen in FIG. 1. A drive assembly 26 is moved by the verge escapement assembly 24 to ultimately turn numbered wheels through a rotational path at predetermined intervals.

The verge escapement assembly 24 which is integrated with the drive assembly, has a verge member 28 which is oscillated in conjunction with teeth 32 extending from drive wheel 30 to rotate the drive wheel effecting ultimately movement of the numbered wheels. A worm gear 34 extending from worm gear shaft 36 is fixed to the drive wheel with a portion of the shaft defining a worm gear pin 38 which is rotatably secured within a pin hole 40 defined in the lower plate 16. In this manner, when the wheel 30 is fixedly secured to the shaft and the worm gear pin 38 located within the pin hole 40, the worm gear 34 can be readily rotated by the action of the verge member 28.

Figure 6:
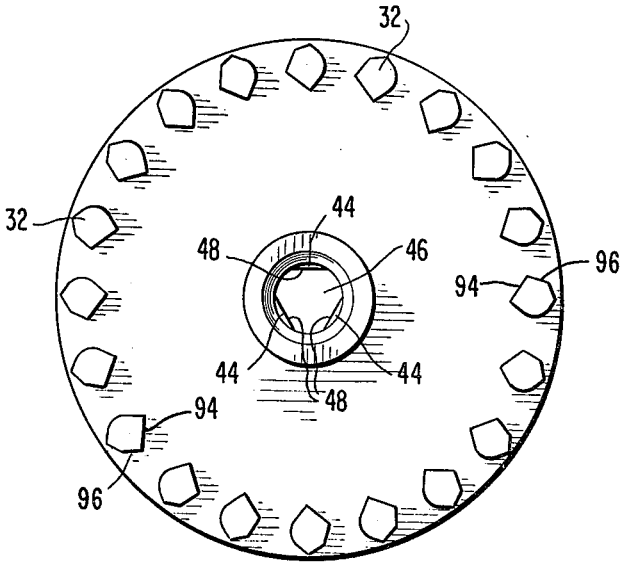
FIG. 6 is an enlarged plan view of the drive wheel illustrating a plurality of teeth arranged at its periphery.
Figure 2:
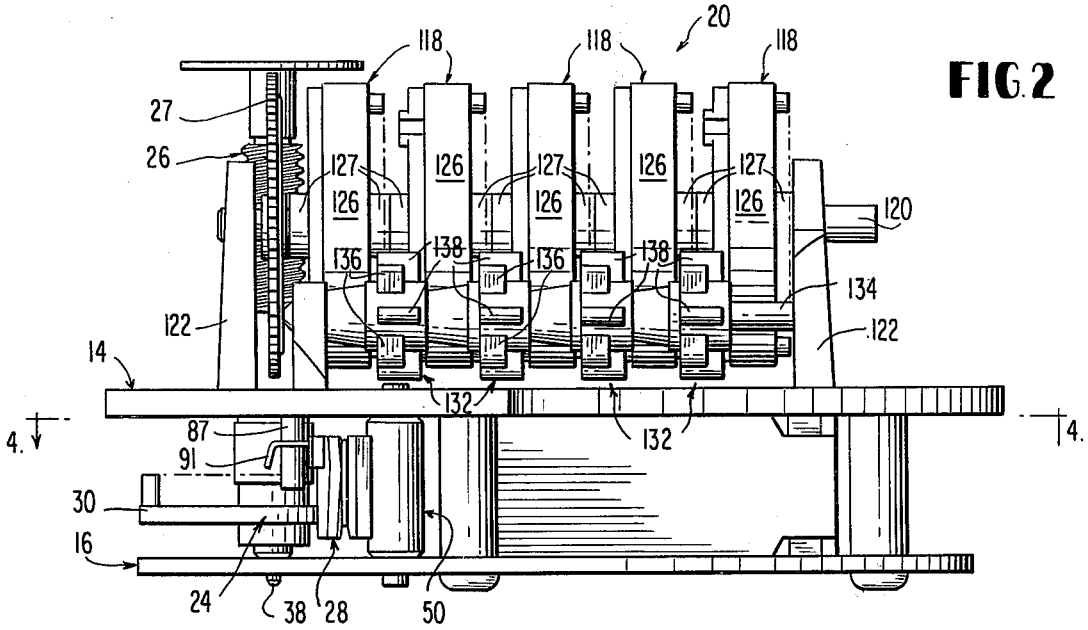
FIG. 2 is a front elevation of the indicator assembly, drive wheel and worm gear, and verge member.
Figure 3:
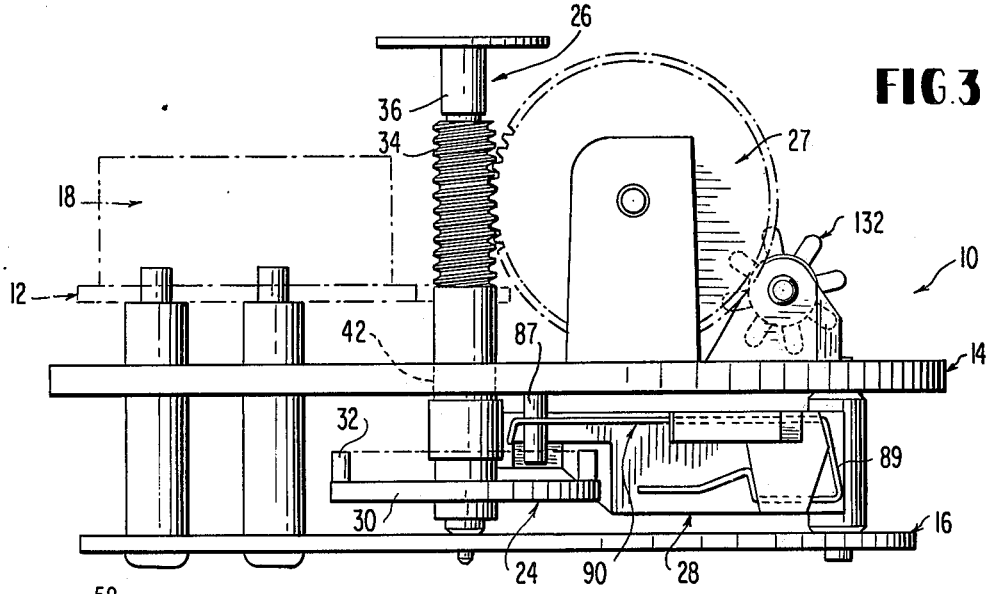
FIG. 3 is a side elevation of the indicator assembly, drive wheel and worm gear, and verge member.

The worm gear 34 extends through worm gear aperture 42 in the middle plate 14 and is exposed sufficiently for engagement with drive gear 27. The worm gear shaft 36 conforms to a set of wheel hole flats 48 in the wheel hole 46 as shown in FIG. 6. In this way the wheel hole flats 48 grip the resulting shaft flats 44 and the drive wheel 30 can be engaged with the worm gear shaft 36 and sufficiently secured such that rotation of the drive wheel 30 will result in corresponding rotation of the worm gear with a reduction sufficient to allow greater diversity in tolerances. As can be seen in FIG. 3, the worm gear rotation about its axis results in rotation of the drive gear 27 about an axis perpendicular to that of the worm gear 34.

Figure 7:
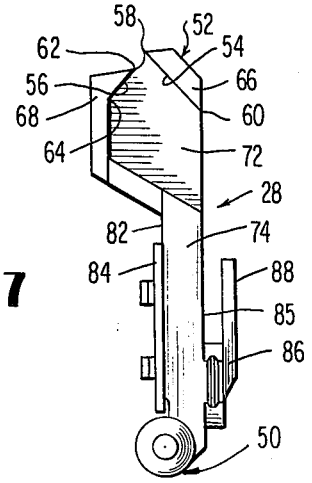
FIG. 7 is an enlarged bottom view of the verge member.
Figure 8:
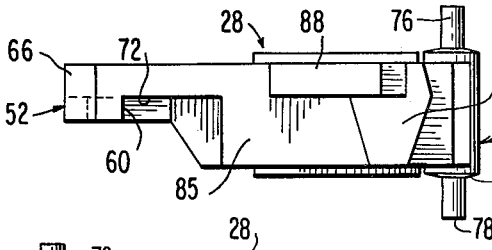
FIG. 8 is an enlarged front elevation of the verge member.
Figure 9:
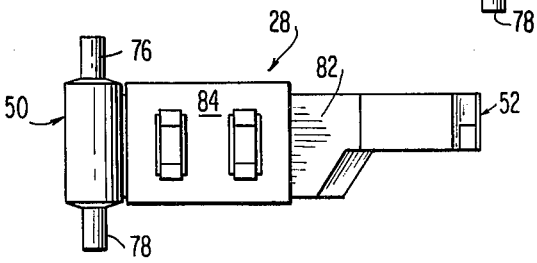
FIG. 9 is an enlarged rear elevation of the verge member.

Reference should be made to FIGS. 7, 8, and 9 during the discussion of the verge member 28. The verge member 28 includes a pivotal end 50 which is pivotally secured between the lower plate 16 and the middle plate 14 and engaging end 52 for movement in a plane substantially parallel to the middle and lower plates 14 and 16 respectively. The engaging end 52 includes a first offset surface 54 and a second offset surface 56 displaced from the first offset surface for allowing engagement of these offset surfaces with the teeth 32 of the drive wheel 30. The first offset surface 54 includes a first front end 58 and a first rear end 60. Similarly, the second offset surface 56 includes a second front end 62 and a second rear end 64.

The first offset surface 54 is defined on an extended wedge block 66 which extends downwardly from a bottom surface 72 at the engaging end 52 of the verge member 28. The second offset surface 56 is defined on an interior wedge block 68 also on bottom surface 72 but displaced from the extended wedge block 66 as can be seen in FIG. 7 to define a gap between the second front end 62 of the second offset surface 56 and the first front end 58 of first offset surface 54. The bottom surface 72 is located relative to the teeth 32 to allow movement of each tooth along and between the surfaces 54, 56 during oscillation of the verge member 28.

In this preferred embodiment, the first offset surface 54 has an angle of 45° plus or minus one degree to the vertical as shown. Similarly, the second offset surface 56 also has an angle of 45° plus or minus one degree to the vertical.

The verge member 28 is integrated with an electromagnet 75 to oscillate the verge member continually between a first and second position. During movement from the first to the second position, the first offset surface 54 engages a tooth 32 on the drive wheel 30 to move it a half interval of rotation. In movement of the verge member 28 from the second position returning to the first position, the second offset surface 56 engages the same tooth 32 initially engaged by the first offset surface 54 to move it the remaining half interval. This achieves a one-step rotation of the wheel 30 about its axis. Of course, this oscillation is continued to continually move adjacent teeth 32 through a step to fully rotate the wheel.

The pivotal end 50 of the verge member 28 is connected to the engaging end by a midsection 74. The pivotal end 50 includes an upper pin 76 which registers with a locating hole in the middle plate 14. A lower pin 78 has a truncated conical portion 80 for resting in a complementary hole defined in the lower plate 16. In this way, the verge member can be quickly located and staked into place between the middle and lower plates 14, 16 in a pivotal disposition. Front side 82 of the midsection 74 carries an armature or metal plate 84 for cooperation with the electromagnet in oscillating the verge member 28 between the first and second position.

The rear side 85 of the verge member includes a slotted boss 86 having an arm 88 extending therefrom spaced from the midsection 74 and substantially parallel thereto. As can be seen in FIG. 3 and FIG. 4, a spring 90, having a locking portion 89 and a spring arm 91, is snapped into place on the slotted boss 86 with the spring arm 91 extending along behind the arm 88, but with a portion of the spring arm 91 extending well beyond the end of the arm 88 so that it can engage spring post 87. The spring is so located with respect to the verge member 28 and the spring post 87 that it is biased away from the coil in its normal first position. In this way, when the electromagnet 75 is energized it acts on the armature 84 carried by the verge member 28 to pull the verge member toward the electromagnet 75 against the action of the spring arm 91. When the electromagnet is de-energized, the action of the spring arm 91, will return the verge member 28 to its initial position. By having the spring arm configured to lie adjacent to the arm 88, more spring pressure will be imparted to the verge member 28 the farther away from the spring post 87 it moves during the energizing mode of the electromagnet 75. This ensures that the verge member will spring back to the normal position when the deenergized mode is achieved.

The electromagnet is formed from a coil 98 comprised of wire 102. Two posts 100 extend downwardly from coil 98 and have portions of the wire 102 wrapped therearound. When the coil 98 is placed in the proper position between the middle and lower plates 14, 16, the posts 100 with the wire 102 will extend through holes in the upper plate allowing the wire to come in electrical communication with portions of the circuit for de-energizing and energizing the coil 98 at predetermined intervals.

Coil 98 further includes a hollow center 104 for receiving portions of a core frame assembly 106. The core frame assembly 106 is characterized by two separate frame members of U-shaped configuration each having a core portion 108 and an outer portion 110 connected by a bottom portion 112. These core frames 106 also are employed in conjunction with the coil 98 to locate it in the proper position. It should be noted that the core portion 108 is substantially smaller in width than that of the outer portion 110 allowing core portions of the two frames to be inserted into the hollow center 104 of the coil 98. The outer portion 110 has upper flat locating pins 114 and lower flat locating pins 116. The middle and lower plates 14, 16 each define locating holes 115 spaced relative to one another for locating and receiving the locating pins 114,116 to fix the coil 98 at the proper position within the device. By using these locating pins 114, 116 with the locating holes 115 for the core frame assembly 106, the coil 98 will be placed in the proper disposition relative to the armature 84 on the verge member 28 as well as locating the posts 100 with the complementary holes for incorporating the coil with the drivers circuit. By using an assembly of unique configuration, the time and effort required in putting the pieces together is greatly reduced. All that is required is that the core portions 108 be slid into place within the hollow center 104 and the outer portions 110 be located via the locating pins 114, 116 and snapped into place. As a result, no unusual gapping procedure is employed to ensure that the correct spacing is maintained between the coil 98 and the armature 84.

Five numbered wheels 118 are located on the counter drive shaft 120 which is carried by brackets 122 within the indicator. The first unit wheel 124 is fixedly secured to the counter drive shaft such that rotation of the shaft will produce a corresponding rotation of the wheel. The additional wheels 126 each have a pair of boss-portions 127 for spacing them from one another a predetermined distance and rotatably securing them to the counter drive shaft 120 allowing them to rotate independently of the first unit wheel 124 except for the interaction with transfer pinions 132. The counter drive gear 27 is fixed at the other end of the counter drive shaft 120 for cooperation with the worm gear to impart rotation to the drive shaft and ultimately to the numbered wheels 118. Transfer pinions 132 are located along a shaft 134, each having alternately-spaced recessed and extended teeth 136 and 138, respectively, for interaction with slots 140 on one side of each adjacent numbered wheel 118 such that rotation of one wheel through an entire interval results in movement of an adjacent wheel through one step.

It should also be noted that each tooth 32 on the drive wheel 30 has a special configuration for cooperating with the first and second offset surfaces 54, 56 of the verge member 28. Each tooth 32 includes a primary engaging surface 94 which cooperates with the first offset surface 54 to move the tooth through a half step. Intersecting this primary surface is a secondary cam surface 96 for cooperating with the second offset surface 56 to move the tooth through a second half step to complete the interval. In this way, the action of each offset surface 54, 56 on each cam surface 94,96 of the tooth advances one full step to ultimately turn the gear and the numbered wheels correspondingly.

In operation, an electrical pulse is supplied to the electromagnet 75 for generating a magnetic flux in the core frame 106 which, in turn, acts on the armature 84 to pull the verge member 28 toward the core frame. As the verge member moves, the first offset surface 54 on the verge member engages the first cam surface 94 of the tooth 32 on the drive wheel 30 indexing the wheel one half step. When the electrical pulse is switched off de-energizing the electromagnet 75, the spring 90 returns the verge member to its original position. During this return stroke, the second offset surface 56 of the verge member engages the secondary cam surface 96 on the adjacent tooth 32 of the drive wheel 30 to index the wheel the remaining half step. The rotation of the drive wheel 30 is transmitted to the unit wheel through the worm gear 34, the counter drive wheel 27 and the counter drive shaft 120. The unit wheel 124 indexes the first transfer pinion 132 once every revolution which causes the middle wheels and remaining transfer pinions to provide the necessary multiples of ten for the indication of elapsed time.

Referring to FIGS. 10 and 11, the time base and driver circuit of the elapsed time indicator is preferably embodied as a solid-state, astable multivibrator circuit which generates pulses at fixed intervals when powered by an ignition voltage, e.g., a 12-volt D.C. battery. To allow the elapsed time indicator to be used in a wide range of applications, the time base and driver circuit is preferably designed to provide satisfactory operation under the following conditions: (1) temperature variations from −40° F. to +185° F., (2) ignition (battery) variations up to ±25% of nominal voltage, (3) electrical noise and high energy transients on the ignition input line, (4) high shock and vibration levels, and (5) coil load requiring a nominal output of 1.25 ampere peak. The solid-state design allows the circuit to be inexpensively built in a small package. The time base and driver circuit is easily calibrated to within ±1% of a desired pulse time interval.

As shown in FIG. 10, the time base and driver circuit includes an astable multivibrator 150 which generates a series of output pulses 152 at predetermined intervals. A pulse forming circuit 154 amplifies and shapes the pulses produced by the astable multivibrator to provide a controlled pulse 156 of desired duration, with excellent rise and fall time. The controlled pulse 156 is applied to a transistor switch 158 which controls the operation of coil 98 of the electromagnet. Zener diode regulator circuit 160 is provided to control the input voltage and a transient protection circuit 162 protects the transistor switch from electrical transients.

Preferably, as shown in FIG. 11, the preferred embodiment of the time base and driver circuit includes a CMOS and quad NAND gate circuit, generally 164, which comprises a plurality of NAND gates 166, 168, 170 and 172. The first pair of NAND gates 166 and 168 is used to provide the astable multivibrator. NAND gates 166 and 168 are connected in series with a feedback path comprising a capacitor 174 and a resistance 176 connected between the output of NAND gate 168 and the input of NAND gate 166. In addition, a pair of series resistors 178 and 180 coupled to the output of NAND site 166 provides a charge/discharge path for capacitor 174. A capacitor 182 connected between the input of NAND gate 166 and ground controls the input voltage applied to the NAND gates.

The second pair of NAND gates 170 and 172 is connected in series and provided with a feedback resistance 184 to define the pulse forming circuit which stabilizes and shapes the pulses produced by the astable multivibrator. A coupling capacitor 186 applies the output of NAND gate 168 to the input of NAND gate 170 across a bias resistance 188 connected to ground. The output of NAND gate 172 is applied via a current limiting resistor 190 to the base of a transistor 194 having its collector connected to coil 98 and its emitter connected to ground. Transistor 194 serves as a switch to control the energization of coil 98. When the transistor is biased off, it is capable of withstanding a voltage of 100 volts. Thus, it is immune to high voltage spikes appearing on the ignition line. A diode 196 connected across coil 98 and transient protection circuit 162 connected between the ignition line and the base of transistor 194 provide additional circuit protection from internal or external electrical transients.

The time base and driver circuit also includes an input diode 198 and a resistance 200 in the ignition line which control the voltage applied to the NAND gates. A zener diode 202 located in the ignition line with a shunt capacitor 204 comprises the zener diode regulator which provides additional voltage control to eliminate the effects of voltage spikes, improper voltage polarity, and variations in pulse duration due to supply voltage fluctuations. The time base and driver circuit is preferably calibrated to produce a nominal pulse width at an interval of 6.0 seconds.

In the operation of the multivibrator circuits when the output of NAND gates 168 goes positive, capacitor 174 initially allows the input of NAND gate 166 to go high. As a result, the output of NAND gate 166 is held low to provide a discharge path through resistance 178 and 180 for capacitor 174. As the capacitor discharges, it reaches a lower voltage where NAND gate 166 switches from a low output to a high output to cause the output of NAND gate 168 to go low and dump the capacitor. With the output of NAND gate 166 high, capacitor 174 is recharged via resistances 178 and 180 at a controlled rate determined by the time constant of the RC circuit comprising resistances 178 and 180 and capacitor 174. When capacitor 174 is sufficiently charged, the output of NAND gate 166 switches from high to low to stop the charging of the capacitor. With the output of NAND gate 168 again high, the cycle repeats itself.

The pulse waveform at the output of NAND gate 168 is applied through capacitor 186 to NAND gates 170 and 172 which provide additional current drive and isolation to establish a controlled pulse width with abrupt rise and fall time. Transistor 194 is normally biased off by the action of resistor 192 connected to ground. Upon application of a positive pulse to its base, transistor 194 is switched on to place coil 98 directly across the ignition voltage. The resulting current pulse through coil 98 provides a magnetic field to actuate verge member 28.

Changes in timing due to voltage variation are greatly reduced by using the CMOS quad NAND gate circuit with its low current draw. This integrated circuit allows the use of a lower voltage zener diode to supply a constant voltage to the time base circuit over a broader range of voltage variation about nominal. In addition, the reduced power requirements of the CMOS circuit allow the time base components to be smaller and less expensive. Resistance of the time base circuit to false firing due to voltage transients, spikes, and radiated noise is provided by the inherent stability of the CMOS integrated circuit, the capacitor protection and the zener control.

The time base circuit employs a fixed timing resistor 180 instead of an adjustable potentiometer to provide fast reliable calibration which will not shift due to vibration. Temperature sensitivity of the time base circuit is reduced by using a precision cermet resistor and a metallized polycarbonate capacitor which have complementary temperature coefficients. Damage to the driver circuit components from both narrow (low energy) and wide (high energy) voltage transients is prevented by the transient protection circuit which is triggered by transients on the power input line.

While a specific embodiment of the invention has been shown and described in detail, it will be understood that the invention may be modified without departing from the spirit of the inventive principles as set forth in the appended claims.

What is claimed is:

1. An inverse verge escapement system for use in an elapsed time indicator comprising:

(a) a housing for holding numbered wheels for indicating elapsed time;

(b) a drive wheel rotatably held within said housing substantially in a predetermined plane and drivingly connected to said numbered wheels for rotating said numbered wheels at predetermined intervals;

(c) said drive wheel having a plurality of teeth upstanding therefrom substantially equally spaced from one another about the periphery of said drive wheel; and;

(d) a verge member oscillating between first and second positions in a plane substantially parallel to the predetermined plane and adapted to drivingly engage one of said teeth in its movement from said first position to said second position and to drivingly engage an adjacent tooth in its return movement from said second position to said first position for rotating said drive wheel at a predetermined rate to effect rotation of said numbered wheels at predetermined intervals.

2. The escapement system according to claim 1 wherein said verge member acts substantially on one side of said drive wheel to engage said teeth and rotate said drive wheel.

3. The verge escapement system according to claim 2 wherein said verge member has a pivot end and an acting end, said acting end including cam means for cooperating with said adjacent teeth of said drive wheel, said verge being pivoted from a first position and a second position, said cam means engaging said alternate teeth during movement between said first position and said second position to move said drive wheel through at least one interval.

4. The verge escapement system according to claim 3 wherein said cam means includes a first cam surface and a second cam surface whereby said first cam surface acts on a tooth of said drive wheel during movement from said first position to said second position and said second cam surface acts on an adjacent tooth in the return movement from said second position to said first position to advance said drive wheel an interval.

5. The inverse verge escapement system according to claim 4 wherein said first cam surface during movement between said first position and said second position engages to tooth to advance it one-half an interval and said second cam surface engages said tooth during movement between said second position and said first position to advance the tooth another half interval whereby action of said first cam surface and said second cam surface engaging said tooth between said first and second position advances said drive wheel one interval.

6. The escape system according to claim 5 wherein said first cam surface is approximately at a 45° angle to the longitudinal axis of said verge member and said second cam surface is at a 45° angle to the longitudinal axis of said verge and substantially perpendicular to said first cam surface.

7. The escapement system according to claim 6 wherein said first and second cam surfaces are offset from each other defining a space therebetween.

8. The escapement system according to claim 7 wherein said first cam surface has a front end and a rear end and said second cam surface has a corresponding front end and a corresponding rear end and said first cam surface having its front end extending radially beyond the corresponding front end of said second cam surface and being displaced circumferentially from said second cam surface to provide for engagement of said first cam surface with said tooth without interference of said second cam surface until after said tooth has been moved a one-half interval.

9. The system according to claim 8 wherein said verge member includes a bottom surface at said engaging end wherein said first cam surface is carried by an extended wedge block and said second cam surface is carried by an interior wedge block, said extended wedge block and said interior wedge block extending upwardly from said bottom surface to define a cavity therebetween and a space between said surfaces such that said tooth being engaged by said cam surfaces can move readily along said cam surfaces between said first and second positions substantially without interference with said bottom surface.

10. The system according to claim 9 wherein said teeth are equally spaced about the periphery of said drive wheel.

11. The system according to claim 10 wherein each of said teeth has complementary cam surfaces for engagement by said first and second cam surfaces on said verge member.

12. The system according to claim 11 wherein said complementary cam surfaces include a first complementary flat surface and a second complementary flat surface for engagement effectively by said first cam surface and said second cam surface on said verge member.

13. The system according to claim 1 further comprising a coil means integrated with an electric circuit for alternately energizing said coil at predetermined intervals, said verge member carrying a metal member for cooperating with said coil to draw said verge member toward said coil.

14. The system according to claim 13 further comprising spring means secured to said verge member for biasing said verge member in a position away from said coil for returning said verge member to a normal position upon de-energizing said coil whereby energizing the said coil moves said verge member from a first position to a second position and de-energizing said coil allows the spring to move said verge member from said second position to said first position.

15. The system according to claim 14 wherein said housing includes a post, said spring means includes a wire spring member having an extended portion and a snap-on portion, said extended portion engaging said posts and said snap-on portion engaging said verge member to maintain said spring on said verge member with said extended portion engaging said post to bias said spring away from said coil.

16. The system according to claim 1 wherein said drive wheel is connected to a worm gear, said numbered wheels are connected to a drive gear and said drive gear being integrated with said worm gear whereby rotation of said worm gear by said drive wheel in turn, rotates the drive gear to move said numbered wheels through predetermined intervals for indicating elapsed time.

17. The system according to claim 16 wherein said drive gear is connected to a drive shaft rotatably secured within said housing, a first numbered wheel being fixed to said shaft whereby movement of said drive gear effects corresponding movement of said first numbered wheel.

18. The system according to claim 17 wherein said numbered wheels include at least a second wheel spaced from said first wheel, said second wheel having teeth spaced around the periphery thereof, a pinion shaft secured within said housing adjacent said first and second wheels, a transfer pinion gear located intermediate said first and second numbered wheels, said pinion gear having pinion gear teeth for engaging teeth on said second wheel and being integrated with said first wheel whereby movement of said first wheel through a predetermined interval will rotate said pinion gear effecting movement of said second wheel.

19. The system according to claim 18 wherein said first wheel includes slot means, said transfer pinion gear includes pinion gear teeth engaging said slot means and said teeth on said second wheel whereby movement of said first wheel through a full rotation effects movement of said pinion gear through a predetermined interval to move said second wheel through another interval by the engagement of said pinion gear teeth with said teeth on said second wheel.

20. The system of claim 19 wherein said pinion gear has alternately recessed teeth intermediate extended teeth, said alternately recessed teeth not being in gear engagement with said slot means whereby said extended teeth engage said first numbered wheels to prevent rotation of said pinion gear until said slot means engages said extended teeth, said alternately recessed teeth and said extended teeth being in gear engagement with said teeth on said second wheel whereby full rotation of said first wheel affects rotation of said transfer pinion from adjacent extended teeth to move said second wheel teeth through a predetermined interval and prevent further rotation until said slot means engages the next adjacent extended tooth on said transfer pinion gear.

21. The system according to claim 20 wherein a series of said numbered wheels are carried on said drive shaft said wheels being spaced from one another, transfer pinions being located on said transfer pinion shaft intermediate said numbered wheels, each of said numbered wheels having teeth extending from the periphery thereof for gear engagement by said transfer pinion gear, each of said wheels further defining slot means for engaging extended teeth on each of said transfer pinion gear, whereby movement of an adjacent tooth through a predetermined interval effects a movement of an adjacent numbered wheel through another predetermined interval.

22. The system according to claim 21 wherein said numbered wheels include five wheels having four pinion gears spaced therebetween.

23. The system according to claim 1 wherein said verge member includes a metal plate, an electromagnet being secured within said housing and integrated with an electrical circuit for energizing and de-energizing said electromagnet at predetermined intervals, said electromagnet being located relative to said metal plate for moving said plate toward said electromagnet upon energizing thereof, said electromagnet having a core frame assembly for positioning said electromagnet within said housing, said housing having an intermediate plate and a lower plate, said plate having locating poles, said core and frame assembly having pin members extending therefrom for engagement with said locating holes to fix said electromagnet at a predetermined position relative to said metal plate within said housing.

24. The system according to claim 23 wherein said core frame assembly includes two sections, a first section and a second section, each of said sections having a portion extending within said electromagnet, a frame section for extending exterior of said core portion for locating said electromagnet within said housing.

25. The system according to claim 24 wherein each section of said core frame assembly has a U-shaped configuration with the frame portion having locating pins extending therefrom for locating said electromagnet with said core portion within said electromagnet within said housing.

26. The system according to claim 1, which includes an electromagnet secured to said housing adjacent to said verge member, and a solid state time base and driver circuit for energizing and de-energizing said electromagnet at predetermined intervals to oscillate said verge member.

27. The system according to claim 26 wherein said time base and driver circuit comprises an astable multivibrator for producing pulses at predetermined intervals, a pulse forming circuit for amplifying and shaping the pulses produced by said astable multivibrator to provide a controlled pulse output, and a transistor switch operable by the controlled pulse output of said pulse forming circuit to energize said electromagnet.

* * * * *

UNITED STATES PATENT AND TRADEMARK OFFICE

CERTIFICATE OF CORRECTION

PATENT NO. : 4,207,733

DATED : June 17, 1980

INVENTOR(S) : Leonard H. Copeland and Joseph B. Wible

It is certified that error appears in the above-identified patent and that said Letters Patent are hereby corrected as shown below:

Column 1, line 65, change "As" to --A--.

Column 3, line 13, change "ultimately" to --ultimate--.

Column 8, claim 5, line 56, change "to" (first occurrence) to --the--.

Column 9, claim 13, line 41, change "electric" to --electrical--.

Signed and Sealed this

*Twenty-fourth* Day of *November 1981*

[SEAL]

*Attest:*

GERALD J. MOSSINGHOFF

*Attesting Officer*

*Commissioner of Patents and Trademarks*